United States Patent [19]

Bourne et al.

[11] 4,002,503

[45] Jan. 11, 1977

[54] TREATMENT OF METALS AND ALLOY

[75] Inventors: Alan Arthur Bourne; Jack Chambers Chaston; Alan Sydney Darling, all of London, England

[73] Assignee: Johnson, Matthey & Co., Limited, London, England

[22] Filed: Apr. 1, 1975

[21] Appl. No.: 564,203

Related U.S. Application Data

[63] Continuation of Ser. No. 76,615, Sept. 29, 1970, abandoned, which is a continuation-in-part of Ser. No. 581,443, Sept. 23, 1966, Pat. No. 3,547,712.

[52] U.S. Cl. ..... 148/11.5 P; 252/472

[51] Int. Cl.[2] ..... B22F 3/20; B01J 23/42; B01J 23/46

[58] Field of Search ..... 75/.5 AB, .5 BB; 148/11.5 P; 252/472

[56] References Cited

UNITED STATES PATENTS

| | | | |
|---|---|---|---|
| 3,366,515 | 1/1968 | Fraser et al. | 148/11.5 P |
| 3,388,010 | 6/1968 | Stuart et al. | 75/.5 BC |

*Primary Examiner*—W. Stallard

*Attorney, Agent, or Firm*—Cushman, Darby & Cushman

[57] ABSTRACT

A method of improving the mechanical properties of a metal or metallic alloy or metallic composition which has been strengthened by inclusion therein of a dispersed non-metallic phase, comprising the steps of subjecting the metal, alloy or composition to cold-working and subsequently annelaing, the extent of cold-working being such that the recrystallization effected during annealing results in an elongated grain structure highly oriented in the direction of working.

2 Claims, No Drawings

TREATMENT OF METALS AND ALLOY

This is a continuation of application Ser. No. 76,615 filed Sept. 29, 1970, and now abandoned, which is a continuation-in-part of Ser. No. 581,443, filed Sept. 23, 1966, now U.S. Pat. No. 3,547,712.

This invention relates to the treatment of metals or alloys or metallic compositions for the purpose of imparting improved mechanical properties thereto, particularly increased strength at high temperatures. The invention is more particularly, but not exclusively, concerned with the strengthening of metals of the platinum group, excluding osmium, especially platinum and alloys of platinum, and in the following, for the sake of simplicity, reference is directed particularly to the treatment of platinum and alloys thereof. It is to be clearly understood, however, that no limitation is intended thereby, and the invention is also applicable to gold and gold alloys, silver and silver alloys, copper and copper alloys, nickel base alloys containing chromium of the Nichrome (Registered Trade Mark) and Nimonic (Registered Trade Mark) types, containing iron and to aluminium and aluminium alloys.

Whilst platinum and alloys of platinum have long been recognised as particularly suitable metals for use where resistance to stress under oxidising conditions at elevated temperatures is required, the mechanical properties of these materials per se did not always meet the ever increasing strength requirements of metals, such as is called for by modern technological advances.

In an endeavour to satisfy this demand for increased mechanical properties, various proposals have been made to strengthen the properties of platinum and platinum alloys by the addition thereto, in the form of a dispersed phase therein, of oxides, such as thoria, zirconia, hafnia, titania, alumina or rare earth metal oxides. Improved results were also found to be obtainable by the use of compounds other than oxides, and the present Applicants have themselves suggested the use of tungsten carbide as a dispersion-hardening addition.

However, whilst platinum, dispersion-hardened or grain-stabilised in one or other of the above manners, was considerably stronger than pure platinum at elevated temperatures, it was by no means entirely satisfactory, mainly owing to its being brittle. Moreover, the creep life of such material was found to be only some 7 to 20 hours when subjected to a tensile stress of 700 lbs/sq.in. at a temperature of 1400° C. It was, moreover, found that, under conditions of severe stress over long periods at elevated temperature, the strengthened material was liable to fail due to fracture at the grain boundaries, particularly those boundaries disposed at right angles to the direction of applied stress.

With the aim of overcoming the above disadvantages, and enabling strengthened material which is not subject to the aforesaid faults to be obtained, the Applicants investigated the problem and have surprisingly found that it can be solved in a simple and highly satisfactory manner.

It is an object of this invention, therefore, to provide a method of improving the mechanical properties of a metal or metallic alloy or composition which has been strengthened by the inclusion therein of a non-metallic phase, such as a dispersed metal oxide phase.

Another object of the invention is to provide a strengthened platinum or platinum alloy or composition having greatly improved mechanical properties.

The invention also includes a method of improving the mechanical properties of a previously strengthened metal composition comprising a noble metal or copper and including, as a dispersed phase, a refractory metal oxide strengthening element, said method comprising the steps of cold-working said composition and subsequently annealing the composition all of the cold-working being carried out prior to the annealing and the extent of cold-working being such that the re-crystallization effected during annealing results in an elongated grain structure highly oriented in the direction of working.

In carrying out the invention, the method may be applied to the treatment of a strengthened noble metal or noble metal alloy or a base metal or base metal alloy or of a strengthened composition formed of compacted and sintered noble metal and/or noble metal alloy powder particles or of compacted and sintered base metal and/or base metal alloy powder particles or of a mixture of any two or more of the above.

By the expression "strengthened metal or metallic alloy or composition", as used herein, is meant a metal, alloy or sintered powder composition to which has been imparted strengthened properties by the inclusion therein of a non-metallic phase, such, for example, as a dispersed phase of a refractory metal oxide, carbide, boride, nitride or silicide.

Generally, the cold-working should produce reduction in cross-sectional area of at least 80%. In the case of platinum and platinum alloys the reduction should be at least 70% and in the case of gold and gold alloys, the reduction should be at least 60%. The temperature at which the subsequent anneal is carried out will vary with the metal under treatment and can readily be ascertained by experiment. In the case of platinum and platinum alloys, a temperature of about 1400° C will be found suitable.

From the foregoing it will be appreciated that in the method of the present invention, all the cold working of the previously strengthened metal, metal alloy or composition is carried out, necessarily in small steps, prior to annealing. Hitherto it has been considered necessary to sequentially work the metal or alloy with a small reduction and thereafter to anneal the cold worked metal or alloy. This sequence or cycle is then repeated so that, inter alia, recrystallisation is kept to a minimum. Inhibition of recrystallisation has therefore been an important factor in previous work in this field. In contra-distinction with what has previously been considered necessary, it is a feature of the present invention that steps are taken which are designed to promote and not to minimise recrystallisation. In this way, metals, alloys and metallic compositions treated in accordance with the present invention cold working encourages maximum grain or crystal elongation oriented in the direction of cold working. The resultant metals or alloys possess exceptionally good mechanical properties at relatively high temperatures.

The following Examples illustrate the manner in which the invention may be carried out in practice, as applied to the treatment of strengthened platinum and rhodium-platinum compositions, it being understood that the invention is in no way limited to, or by, these Examples.

EXAMPLE I

A sintered platinum ingot, prepared from platinum powder containing 0.04% of titanium carbide powder and measuring 2-1/16 × 1-1/16 × 8¼ inches and weighing 140 ounces was hot forged to a bar ⅝ inch square. This was then cold-worked to ⅛ inch diameter rod and a part of the rod subsequently drawn to 0.040 inch diameter wire and finally both the rod and the wire were annealed at a temperature of 1400° C. to cause the required recrystallisation. Creep tests were made on samples of the rod and wire with the results indicated below:

| Diameter inch | % Reduction in area | Life at 1400° C 700 p.s.i. | Life at 1400° C 1400 p.s.i. |
|---|---|---|---|
| 0.125 | 97 | 800 hrs. | 4–12 hrs. |
| 0.040 | 99.7 | >1200 hrs. | 350 hrs. |

Micro-examination of the recrystallised grain structure showed that the length/width ratio of the grains of the ⅛ inch diameter rod was approximately 5, whilst that of the grains in the 0.040 inch diameter wire was approximately 12.5.

EXAMPLE II

In another experiment four small sintered ingots were prepared from platinum powder containing 0.04% of titanium carbide. After sintering in vacuum for 3 hours at 1400° C., these ingots were hot forged, reduced to sheet by cold rolling and finally annealed at 1400° C. The following table summarises the results obtained when these ingots, worked in different ways, were subjected to a tensile stress at 1400° C. in air.

| Ingot No. | Method of fabrication | Cold work Total reduction of area | Life in hours at 700 p.s.i. and 1400° C. |
|---|---|---|---|
| 1 | Directly cold rolled after hot forging | 58 | 100 |
| 2 | Directly cold rolled after hot forging | 86 | 312 |
| 3 | Ingot repressed and resintered before forging and rolling | 86 | 570 |
| 4 | Ingot cold swaged before cold rolling | 86 | 620 |

Micro-examination of the sheet after creep testing disclosed a highly elongated grain structure in material from ingots 3 and 4, significant elongation in sheet from ingot 2, and little, if any, elongation in sheet from ingot No. 1.

EXAMPLE III

To a batch of platinum powder, which had been sieved to pass through a 60 mesh B.S. sieve, and washed to remove any soluble trace impurities, 0.04% by weight of titanium carbide powder, finer in diameter than 5 microns, was added. This powder mixture was then ball-milled dry, in a rubber mill using steel balls, for a period of 24 hours.

This powder mixture, which was hard and difficult to compact, was then annealed in vacuum for two hours at 800° C. until it became capable of being pressed to bars under a pressure of about 8 tons per square inch. The bars so formed were then sintered in vacuum at 1400° C. for a period of 3 hours, hot forged, and finally cold drawn to wire. The reduction in area accomplished by the cold drawing was approximately 97%. The wire was then annealed at a temperature of 1400° C.

Creep tests carried out on wire produced in the above described manner provided results as tabulated below:

| Tensile stress (lbs/sq.in.) | 2100 | 1950 | 1800 | 1400 | 700 |
|---|---|---|---|---|---|
| Life in air at 1400° C (hours) | 5 | 50 | 560 | 1006 | 1500 |

EXAMPLE IV

To 15 ounces of sieved and washed platinum powder was added 0.04% of micron grade titanium carbide powder and the mixture ball-milled for 24 hours. This mixture was vacuum-annealed for 2 hours at 800° C. and carefully poured into a steel die ⅝ inch wide and compacted under a pressure of 10 tons per square inch. The pressing was then sintered at 1400° C. in vacuum for 3 hours, allowed to cool, repressed to 80% of its theoretical density and resintered for 2 hours at 1400° C.

After hot forging in the plane of pressing the bar was then cold rolled to sheet, samples being taken at various stages of reduction. The samples were then annealed at a temperature of 1400° C. to effect recrystallisation.

Creep tests on sheet made from this batch of platinum showed the followed results:

| Creep test data sheet from 15 ounce ingot (1400° C., 700 p.s.i.) | |
|---|---|
| % reduction in area by cold rolling | Lifetime before failure (hours) |
| 87 | 40 |
| 92 | 55 |
| 96 | 200 |

EXAMPLE V

Sieved rhodium and platinum powders were mixed in the ratio of one to nine and then milled together for 24 hours with 0.04% of titanium carbide.

This mixture was vacuum-annealed, compacted and vacuum-sintered for 3 hours at 1400° C. After hot forging at about 1100° C it was then drawn to wire 0.040 inch diameter, being subjected during the cold-working to a total reduction in area of approximately 97%. Subsequent annealing at 1400° C. developed a highly elongated grain structure. Creep tests on this material, during which a tensile stress of 700 lbs/sq.in. was applied at 1400° C., showed a life of approximately 2000 hours.

Tests under similar conditions on rhodium-platinum alloy, strengthened with thoria and treated in accordance with the invention, showed a creep life of only 1000 hours before failure.

TABLE 2-continued

| Constant Load Creep Tests on Platinum Containing 0.13% by wt. of Zirconium Oxide (Tests made in air at 1400° C.) | | |
|---|---|---|
| | Life in Hours for Material Worked:- | |
| Applied Stress (lbs/sq.inch) | (a) 6% before recrystallisation | (b) 98% before recrystallisation |
| 2800 | 5 | 70 |

TABLE 3

| Results of Some Constant Load Tests at 1400° C. | | | |
|---|---|---|---|
| Percentage by wt. | Stress for 10 hour life | Stress for 100 hour life | Stress for 1000 hour life |
| 0.3% Calcium oxide (98% Red. before recrystallisation) | 1000 | 670 | 425 |
| 0.18% $ThO_2$, 98% Red. | 1150 | 780 | 525 |
| 60% Red. | 800 | 500 | 350 |

EXAMPLE VI

Table 1 (see below) summarises the results of some tests on platinum containing various quantities of zirconium oxide. These tests were made in air, under tension, at 1400° C. and it can be seen that heavy cold reductions prior to recrystallisation provide greatly improved properties. Further results of tests on platinum strengthened with zirconium oxide are given in Table 5. In this case the results of individual tests at stresses of 700, 1400 and 2800 pounds per square inch are included.

Other oxides, for various reasons, have been found to be less effective than zirconia as strengthening agents for platinum. In spite of this inferiority, however, there is no doubt that the basic properties of such composite materials are considerably improved by working and recrystallisation in accordance with the teachings of our invention. Some typical results which illustrate these effects are presented in Tables, 2. 3 amd 4 as set out below.

TABLE 4

| Tests on Platinum Strengthened with 0.10% by weight of Titanium Monoxide | | | | | |
|---|---|---|---|---|---|
| | 98% Prior Reduction | | | 60% Prior Reduction | |
| Tensile Stress lb/in² | 700 | 1400 | 2800 | 700 | 1400 |
| Minimum Life Hours | 1000 | 800 | 30 | 150 | 30 |

EXAMPLE VII

Two batches of dispersion strengthened gold were produced from a batch of high purity gold grain. One batch of dispersion strengthened gold contained 0.1% by wt. of the compound TiO Titanium oxide finely and uniformly distributed throughout the body of the material. The other batch contained 0.08% by wt. of a similarly distributed dispersion of alumina ($Al_2O_3$). Both batches of these strengthened golds were produced in the form of rectangular ingots having a cross section of approximately 1 cm. square. A similar ingot of pure gold to which no dispersion had been added was produced from the same batch of gold grain as the dispersion strengthened materials. This pure gold ingot was used for reference purposes. All three ingots were square rolled to rod, during which operation the cross section of the area was reduced by 40%. Part of this rod was put on one side for subsequent testing, the remainder being swaged to round rod at which stage the total

TABLE 1

| Tests on Platinum Containing Zirconium Oxide Dispersants (Tested in air in tension at 1400° C) | | | | |
|---|---|---|---|---|
| | | Stress for life of:- | | |
| Weight Addition Weight Percent | Cold Reduction Before recrystallisation at 1400° C. | 10 hours | 100 hours | 1000 hours |
| 0.13 % $ZrO_2$ | 98% | 4800 psi | 2700 psi | 1490 psi |
| 0.13% $ZrO_2$ | 60% | 2300 psi | 1100 psi | 600 psi |
| 0.08% $ZrO_2$ | 98% | 4400 psi | 1850 psi | 790 psi |
| 1.04% $ZrO_2$ | 98% | 9750 psi | 6280 psi | 3850 psi |
| 1.04% $ZrO_2$ | 70% | 3400 psi | 2800 psi | 2300 psi |

TABLE 2

| Constant Load Creep Tests on Platinum Containing 0.13% by wt. of Zirconium Oxide (Tests made in air at 1400° C.) | | |
|---|---|---|
| | Life in Hours for Material Worked:- | |
| Applied Stress (lbs/sq.inch) | (a) 6% before recrystallisation | (b) 98% before recrystallisation |
| 700 | 400 | > 2000 |
| 1400 | 45 | 800 |

amount of cold work imposed represented a reduction in area of 60%. This round rod was then drawn into fine wire at which stage a total area reduction of 98% had been achieved. Samples of the three batches of gold in the form of square rod, round rod and wire were then annealed, all in the same furnace, in air for 5 hours at 700° C. The results obtained when these materials were subsequently tested in tension, in air, at 700° C. are tabulated below:

Effect of Cold Working and Recrystallisation on the Resistance to Tensile Creep of Dispersion Strengthened Gold.

| | | | | DISPERSION | | | | | |
|---|---|---|---|---|---|---|---|---|---|
| | NIL | | | 0.10% by wt TiO | | | 0.08% by wt. $Al_2O_3$ | | |
| Degree of cold working imposed % | 40 | 60 | 98 | 40 | 60 | 98 | 40 | 60 | 98 |
| Temperature and time of annealing | | | | 5 HOURS AT 700° C | | | | | |
| Creep life at 700 p.s.i. 700° C (Hours) | 5 | 6 | 6 | 21 | 160 | 300 | 17 | 110 | 150 |

The creep lives obtained showed that the working and annealing procedures were effective on the two dispersion strengthened products and significant improvements became apparent only after reductions in area of 60% had been imposed prior to recrystallisation.

In order further to demonstrate the very considerable advantages obtained with the improved material in accordance with the invention, creep tests were carried out on specimens of platinum metal strengthened in various ways and treated in accordance with the method of the invention, together, for comparison purposes, with similar tests under similae conditions on specimens of platinum metal prepared by normal casting and powder metallurgical procedures and also of platinum metal strengthened by oxide and carbide additions but not treated in accordance with the invention.

In carrying out these tests, the following test specimens were first prepared as follows:

A quantity of platinum powder was sieved through a 60 mesh gauze and then divided into 12 batches A,A' - E.E' of 100 grams, which were separately treated in the following manners:

Batches A,A': Melted and cast platinum ingots

Two batches were melted in air in alumina crucibles, cast into ingots of approximately ½ inch square and one ingot was carefully reduced by cold forging to thick sheet from which the test specimen A was machined. The forging was carried out gently with frequent intermediate annealing. The other ingot was reduced by cold forging, swaging and finally by drawing to 1 mm wire, Specimen A', a total cold reduction of about 99.5% in area, followed by recrystallisation annealing, in accordance with this invention.

Batches B and B': Consolidated platinum powder

Two batches were pressed in a steel die at a pressure of approximately 10 tons/sq.inch to form rectangular compacts which were vacuum sintered at 1400° C. for 2 hours. The compacts were then hot forged in air at 1150°–1200° C. for a total reduction in area of 40–45% until the theoretical density of platinum had been obtained. One ingot was formed into sheet and a test specimen B was machined from the product. The other forged ingot was cold swaged and drawn to 1 mm wire and recrystallisation annealed in accordance with the invention, to form Specimen B'.

Batches C and C': Consolidated platinum powder with titanium carbide addition

Each of these batches was made by adding to 100 grams of platinum powder 0.04% by weight of micron grade titanium carbide powder and thoroughly mixing by tumbling. The mixtures were then compacted into rectangular ingots at a pressure of 10 tons/sq. inch and sintered at a temperature of 1400° C. for 2 hours. The sintered bars were then hot forged to consolidate them and one was reduced by a 60% cold reduction to sheet and the other treated and worked so as to produce 90% reduction to provide specimens C and C' respectively.

Batches D and D': Platinum powder with thoria addition

These batches were prepared by adding, to each of two 100-gram batches of platinum powder, 1.14 grams of thorium nitrate dissolved in 20 ccs. of distilled water. The suspension was mixed to form a smooth paste and dried at a temperature of 100° C. The paste was then heated for 3 hours at a temperature of 800° C. in hydrogen to convert the thorium nitrate to thorium oxide, the final content of which was approximately 0.05% by weight. The two batches were then ball-milled dry in a polypropylene mill with tungsten carbide balls for 12 hours. Pressed compacts produced from this thoria-containing powder mixture were then sintered in hydrogen for 1 hour at 1400° C., repressed to 85% of the theoretical density, resintered for 1 hour at 1400° C. in hydrogen and finally respectively treated as above described to form, respectively, sheet, (Specimen D), and cold-worked and annealed wire, (Specimen D').

Batches E and E': Platinum powder with titanium carbide addition

To each of two 100 grams of platinum powder batches was added 0.04% by weight of micron grade titanium carbide powder, with thorough mixing by tumbling, and then the mixture was ball-milled dry with tungsten carbide balls for 12 hours.

This powder mixture was then annealed at a temperature of 800° C. for 4 hours in vacuum and then compacted at a pressure of 10 tons/sq.inch and sintered in vacuo at 1400° C. for a period of 3 hours. The resulting sintered compacts were then repressed to bring the density up to 85% of the theoretical density and resintered at 1400° C. for 3 hours. Finally, both compacts were consolidated by hot forging, one being then reduced to sheet to form Specimen E and the other being cold-worked to wire and recrystallisation annealed, in accordance with the invention, to form Specimen E'.

Creep tests carried out in each of the above, with an applied tensile stress of 700 p.s.i. at a temperature of 1400° C. gave the results summarised below:

| Specimen: | TIME TO FRACTURE: |
|---|---|
| A | 1 hour |
| A' | 1 hour |
| B | 1¼ hours |
| B' | 1 hour |
| C | 20 hours |
| C' | 50 hours |
| D | 250 hours |
| D' | 324 hours<br>Strong <110> <210> Recrystallisation Texture Significant reorientation of grains into the <110> and <210> directions had occurred. |
| E | 400 hours |
| E' | 2000 hours<br>Strong <110> <210> Recrystallisation Texture Significant reorientation of grains into the <110> and <210> directions had occurred. |

As will be readily appreciated from the above, strengthened platinum, when treated in accordance with this invention, exhibits greatly improved mechanical properties compared with strengthened platinum which has not been so treated but which has been subjected to the same test conditions. Further, the test results for specimens AA' and BB' show that there is no improvement in the mechanical properties of unstrengthened platinum when ingots made from this material are cold worked and then annealed.

FIGS. 1, 2 and 3 of the accompanying drawings illustrate the recrystallised microstructures of wire from a cast platinum ingot (FIG. 1), sheet made from platinum powder with addition of 0.04% of TiC showing the beginning of an orientated structure (FIG. 2) and finally the highly orientated structure of a wire produced from platinum powder containing TiC and recrystallised at 1400° C, after heavy cold-working in accordance with the teaching of this invention (FIG. 3).

Although the invention has been particularly described above in relation to the treatment of strengthened platinum and platinum alloys, it is to be understood that the invention is equally applicable to the treatment of other metals and alloys of the platinum group and also to other noble metals and also to base metals and alloys.

Thus, in addition to the above tests on platinum, further comparative tests were made using copper powder in place of platinum. The powder used for these tests was produced electrolytically of a fineness of less than 200 mesh.

Specimens G and G': These specimens were prepared in the following manner 50 grams of copper powder were reduced in hydrogen at 350°–400° C for a period of 4 hours. The reduced powder was mixed with 0.04% by weight of micron grade titanium carbide powder and the resulting mixture was then dry milled in a polypropylene mill using steel balls for a period of 12 hours. The powder was then divided into two specimens each of which was annealed in vacuo at 450° C. for 2 hours, made into a compact at a pressure of 10 tons/sq.inch, and the compact sintered in vacuo for a period of 4 hours at a temperature of 900°–950° C. The compacts were then consolidated by gentle cold forging and annealed in hydrogen at a temperature of 500° C. One specimen G was then further reduced by gentle cold-working with frequent intermediate annealing steps, so as to introduce the minimum possible working texture. The other specimen G' was subjected to heavy cold-working to effect a reduction of about 80% and then recrystallisation-annealed in accordance with the invention at a temperature of 350° C.

Creeptests carried out on each of the above specimens produced the results summarised below. The tests were each carried out in air at a temperature of 350° C. and under a tensile stress of 5 tons/sq.inch.

| SPECIMEN: | TIME TO FRACTURE: |
|---|---|
| G | 163 hours |
| G' | 500 hours |

A metallographic examination of certain specimens in accordance with the invention and exemplified herein showed at least 50% of the crystals or grains orientated with their major axes (as herein defined) lying within ± 30° of the direction of working and other specimens showed at least 95% of the crystals or grains with their major axes (as herein defined) lying within ± 20° of the direction of working.

Again, the beneficial results obtainable by means of the invention are clearly obvious and require no further emphasis.

It is also to be understood that the invention is intended to include within its scope any metal or alloy which has been treated by the method of the invention and any article formed of, or incorporating, such metal or alloy.

It is further to be understood that the term "cold-working" is not intended to be limited to working at room temperature, as the actual temperature employed will depend to a large extent upon the metal or alloy undergoing the treatment, it being important, however, to ensure that the temperature employed is below that at which significant recrystallisation occurs.

All the possible uses to which the invention may be put are too numerous to recite herein, since the fundamental discovery on which the invention is based, namely, the ability greatly to improve the mechanical properties of dispersion strengthened or grain-stabilised metals or alloys by cold-working and subsequent recrystallisation is of universal application in the production of metallic materials for any purpose in which the improved properties attainable by means of the invention are desirable or advantageous. For example, dispersion-strengthened platinum group metals or alloys treated in accordance with the invention may be advantageously employed for the manufacture of apparatus used in the glass industry, such as bushings, used in the production of glass fibres, melting crucibles and stirrers. Another useful application is in the manufacture of resistance thermometers, thermocouples, in which resistance to mechanical failure at high temperature is important, and electrical resistance furnace windings.

A particularly useful application of the invention, however, will be found to be in the field of catalysts, especially catalyst gauzes, employed in chemical processes, such as the manufacture of nitric acid by oxidation of ammonia or the synthesis of hydrogen cyanide from methane and ammonia.

Catalyst gauzes are usually woven from wire of platinum or a platinum-rhodium alloy, preferably containing 5 to 10% rhodium in the alloy. Wire made of a platinum-rhodium alloy is generally preferred owing to its greater mechanical strength compared with that of pure platinum, and, in some instances, its higher catalytic activity compared with the pure metal. For example, in the conversion of methane and ammonia to hydrocyanic acid, by the Andrussov process in which the operating temperatures are in the region of 900°–1200° C., a catalyst gauze of platinum-rhodium alloy exhibits the same conversion efficiency as pure platinum gauze but the former has the better mechanical properties at the temperatures involved. Conversion efficiencies of the order of 95–97% can be obtained in the ammonia oxidation process and higher efficiencies can be obtained by increasing the operating temperature of the catalyst gauze at the expense of the operating life of the catalyst, the maximum temperature at which the gauze can be operated being determined so as to give the catalyst an economically acceptable operating life.

The Applicants have found that if the catalyst gauzes are made from platinum or platinum alloy wire composed of strengthened or grain-stabilised platinum or platinum alloy composition which has been treated by the method of this invention, greatly improved mechanical properties are obtained.

The invention is intended, therefore, to include within its scope a catalyst gauze for use in carrying out chemical reactions, which gauze is composed of, or formed from, wire of strengthened platinum or platinum alloy, which has been treated in accordance with this invention and also any catalytic reaction process which involves the use of such a catalyst gauze.

Catalyst gauzes, in accordance with this invention, will be found to offer considerable advantages over existing catalyst gauzes when used in similar processes and under similar operating conditions. The conversion efficiency of the catalyst will be found to be at least equal to, if not better than, a normal catalyst of a platinum or platinum-rhodium alloy wire gauze, whilst the dimensional changes, surface changes and weight changes will be found to be less than those of existing types of catalyst gauzes. Furthermore, a catalyst gauze embodying this invention, will be found to be considerably less subject, at any given temperature, to distortion and creep than are existing platinum or platinum-rhodium catalyst gauzes; the gauze can, therefore, be operated at higher temperatures and will provide higher conversion efficiencies than in the case with catalyst gauzes which have not been made in accordance with this feature of the invention.

In order to demonstrate the improved results obtained by the use of catalyst gauzes made in accordance with this feature of the invention, the following tests were carried out on gauzes made from wires *a*, *b* and *c* as defined below:

a. a reorientated and grain stabilised 10% rhodium-platinum alloy containing 0.04% titanium carbide and treated in accordance with the invention;
b. melted and cast 10% rhodium-platinum. This material which contained no dispersion strengthened phase had not been treated in accordance with the invention, and
c. a reorientated and grain stabilised platinum metal containing 0.04% titanium carbide which had been treated in accordance with the invention.

The tests included experiments to show 1. the effect on the conversion efficiency of the catalyst gauzes of the space velocity of the ammonia-air stream in the manufacture of nitric acid by the oxidation of ammonia on the catalyst gauze;
2. the effect of temperature variations on the conversion efficiency of the catalyst gauzes, and
3. the breaking strength of the catalyst gauzes before and after exposure to the reacting gases.

The results of these tests are given into the following Tables I, II and III and clearly show the improved results obtainable by catalyst gauzes prepared in accordance with the invention. In the following tables tabulated in sections (a), (b) and (c) respectively were obtained when testing catalyst gauzes made from wires having compositions *a*, *b* and *c* as defined above.

TABLE I

INFLUENCE OF SPACE VELOCITY ON CONVERSION EFFICIENCY:

(a) Reoriented grain-stabilised 10% rhodium-platinum:
10% ammonia : gauze temperature 820° C.

| Space Velocity ft.sec.$^{-1}$ | Conversion Efficiency, % |
|---|---|
| 0.340 | 97.0 |
| 0.535 | 94.25 |
| 0.675 | 93.0 |
| 0.900 | 92.0 |
| 1.150 | 87.5 |

(b) Conventional 18% rhodium-platinum:
10% ammonia : gauze temperature 820° C.

| Space Velocity, ft.sec.$^{-1}$ | Conversion Efficiency, % |
|---|---|
| 0.225 | 91.5 |
| 0.348 | 90.7 |
| 0.790 | 90.0 |
| 1.010 | 88.5 |
| 1.150 | 87.8 |

(c) Reoriented grain-stabilised platinum:
10% ammonia : gauze temperature 820° C.

| Space Velocity, ft.sec.$^{-1}$ | Conversion Efficiency, % |
|---|---|
| 0.225 | 33.0 |
| 0.338 | 78.0 |
| 0.563 | 90.0 |
| 0.900 | 98.0 |
| 1.010 | 87.5 |
| 1.150 | 59.0 |

TABLE II

INFLUENCE OF TEMPERATURE ON CONVERSION EFFICIENCY:

(a) Reoriented grain-stabilised 10% Rhodium-platinum (Invention)
10.8% ammonia : 0.348 ft.sec.$^{-1}$ space velocity at N.T.P.

| Temperature ° C. | Conversion Efficiency, % |
|---|---|
| 670 | 80.5 |
| 730 | 92.0 |
| 780 | 97.0 |
| 810 | 100.0 |

(b) Conventional 10% rhodium-platinum (Prior Art)
10.8% ammonia : 0.348 ft.sec.$^{-1}$ space velocity

| Temperature ° C. | Conversion Efficiency, % |
|---|---|
| 715 | 75.0 |
| 760 | 84.8 |
| 810 | 90.8 |
| 835 | 94.0 |

TABLE II-continued

| INFLUENCE OF TEMPERATURE ON CONVERSION EFFICIENCY: | |
|---|---|
| (c) Reoriented grain-stabilised platinum (Invention) | |
| 10.8% ammonia : 0.348 ft.sec.$^{-1}$ space velocity | |
| Temperature ° C. | Conversion Efficiency, % |
| 820 | 78.5 |
| 840 | 82.5 |

TABLE III

| BREAKING STRESS OF CATALYST GAUZES BEFORE AND AFTER REACTION | | |
|---|---|---|
| | Before Reaction | After Reaction |
| 10% Rh/Pt | 28,100 p.s.i. | 11,400 p.s.i. |
| Reoriented 10% Rh/Pt | 60,500 p.s.i. | 51,000 p.s.i. |

The results given in Table I were obtained using a 10% ammonia-air stream and a catalyst gauze temperature of 820° C.

The results given in Table II were obtained at a gauze temperature of between 660° and 840° C. with the use of a 10.8% ammonia-air stream with a space velocity of 0.348 st./sec.

As will be seen from Table III, the room temperature strength of the gauze embodying the invention was considerably greater than the conventional 10% Rh/Pt alloy gauze and its strength decreased by only 15.7% compared with a decrease of 50.4% in the case of the untreated alloy gauze.

In addition to the foregoing examples, the following example indicates the applicability of the present invention to the treatment of dispersion strengthened nickel.

A solid solution alloy to the composition nickel-0.11 wt% aluminum was prepared by melting together Specpure nickel and high purity aluminium on a water cooled copper hearth in an argon arc furnace. The alloy ingot was reduced by conventional techniques to 1/16 inch diameter wire which was then sprayed under oxidising conditions from an oxy-acetylene flame spraying pistol into a rectangular copper mould. The resulting bar was annealed in hydrogen for 4 hours at 850° C, and then cut into 3 sections which were hot forged, hot swaged and finally cold drawn to wires 0.040 inch in diameter. The reductions in area accomplished by cold drawing were 92.5, 97.5 and 98.4%. The wires were then annealed at 1000° C.

Creep tests carried out on the wires produced in the above described manner provided the following results:

| Constant Load Creep Tests on Nickel Containing 0.5% by Volume of Aluminium Oxide at 1000° C and 8250 p.s.i. | |
|---|---|
| Cold reduction before recrystallisation at 1000° C | Lifetime before failure (hrs) |
| 92.5 | 0.7 |
| 97.5 | 1.2 |
| 98.4 | 10 |

What is claimed is:

1. In a method of improving the mechanical properties of a previously strengthened metal composition comprising a platinum-rhodium alloy and including, as a dispersed phase, zirconium oxide as a strengthening element, said method comprising the steps of cold-working said composition by working the same at a temperature below that at which substantial recrystallization occurs and subsequently annealing the composition, the improvement whereby all of said cold-working at a temperature below that at which substantial recrystallization occurs is carried out prior to any annealing and the extent of cold-working is such that the recrystallization effected during annealing results in an elongated grain structure highly oriented in the direction of working.

2. The method of claim 1 wherein the the cold-working is such that the cross-sectional area of said composition is reduced at least 70% and the composition is annealed at about 1400° C.

* * * * *